US009067765B2

(12) United States Patent
Spies et al.

(10) Patent No.: US 9,067,765 B2
(45) Date of Patent: Jun. 30, 2015

(54) RAIL FOR SUSPENDED CONVEYORS AND SUSPENDED CRANES

(75) Inventors: Gerd Spies, Herdecke (DE); Stefan Fitzler, Iserlohn (DE)

(73) Assignee: Terex MHPS GmbH, Duesseldorf (DE)

( * ) Notice: Subject to any disclaimer, the term of this patent is extended or adjusted under 35 U.S.C. 154(b) by 152 days.

(21) Appl. No.: 13/821,785

(22) PCT Filed: Sep. 5, 2011

(86) PCT No.: PCT/EP2011/065324

§ 371 (c)(1),
(2), (4) Date: Mar. 8, 2013

(87) PCT Pub. No.: WO2012/034892

PCT Pub. Date: Mar. 22, 2012

(65) Prior Publication Data

US 2013/0167749 A1 Jul. 4, 2013

(30) Foreign Application Priority Data

Sep. 14, 2010 (DE) ..... 10 2010 037 522

(51) Int. Cl.

| | |
|---|---|
| ***B66C 7/02*** | (2006.01) |
| ***B66C 7/04*** | (2006.01) |
| ***E01B 25/24*** | (2006.01) |

(52) U.S. Cl.

CPC ... *B66C 7/02* (2013.01); *B66C 7/04* (2013.01); *E01B 25/24* (2013.01)

(58) Field of Classification Search

CPC ..... B66C 7/02; B66C 7/04; B66C 7/08; B66C 6/00; E01B 25/54; E01B 25/22

USPC ..... D25/121; 104/89, 94, 106, 109, 93, 104/111, 172.4, 91; 16/94 R, 87 R, 96 R; 212/315, 71; 248/58

See application file for complete search history.

(56) References Cited

U.S. PATENT DOCUMENTS

| | | |
|---|---|---|
| D47,724 S | 8/1915 | Heulings, Jr. |
| D47,725 S | 8/1915 | Heulings, Jr. |

(Continued)

FOREIGN PATENT DOCUMENTS

| | | |
|---|---|---|
| CA | 1203194 | 4/1986 |
| CH | 429816 | 2/1967 |

(Continued)

OTHER PUBLICATIONS

English translation of International Preliminary Report on Patentability from corresponding International Application PCT/EP2011/065324.

(Continued)

*Primary Examiner* — Mark Le

(74) *Attorney, Agent, or Firm* — Gardner, Linn, Burkhart & Flory, LLP

(57) ABSTRACT

A rail for suspended conveyors and suspended cranes, having a substantially C-shaped profile head for suspending the rail and a profile body connected thereto. The profile head is open at the top, thereby forming a gap running along a longitudinal center plane bounded on both sides by first web segments extending outward from the center plane. Two second web segments opposite each other and running downward and outward as seen in cross section are connected to the first web segments and the rail is made of two profiles disposed symmetrically about the vertical longitudinal center plane as seen in cross section. The rail supports an overload protection in the region of the profile head, and allows simple attachment by suspension supports. In a particular embodiment the first web segments run diagonally outward and upward and the first web segments are angled relative to the longitudinal center plane.

20 Claims, 5 Drawing Sheets

(56) References Cited

U.S. PATENT DOCUMENTS

| | | | | |
|---|---|---|---|---|
| D158,461 | S | 5/1950 | Hammerly | |
| D189,447 | S | 12/1960 | Attwood | |
| 3,124,239 | A | 3/1964 | Kornylak | |
| D200,099 | S | 1/1965 | Attwood | |
| 3,183,480 | A | 5/1965 | Adler, Jr. | |
| 3,452,501 | A | 7/1969 | Zimmer et al. | |
| D238,510 | S | 1/1976 | Tabler | |
| D238,777 | S | 2/1976 | Rodney | |
| 3,974,777 | A | 8/1976 | Monne | |
| 4,102,007 | A | 7/1978 | Janson | |
| 4,524,698 | A | 6/1985 | Tourtellier et al. | |
| 4,768,442 | A | 9/1988 | Miller | |
| D306,078 | S | 2/1990 | Whitney | |
| 5,074,407 | A | 12/1991 | Brumby | |
| 5,271,586 | A | 12/1993 | Schmidt | |
| D346,260 | S | 4/1994 | Silbersky et al. | |
| 5,400,717 | A | 3/1995 | Hoehn | |
| 5,410,937 | A | 5/1995 | Okamoto et al. | |
| 5,443,151 | A | 8/1995 | Taylor | |
| 5,598,785 | A | 2/1997 | Zaguroli, Jr. | |
| D381,176 | S | 7/1997 | Patois et al. | |
| D384,470 | S | 9/1997 | Kubsik et al. | |
| 5,704,571 | A | 1/1998 | Vargo | |
| 6,196,133 | B1 * | 3/2001 | Fitzler et al. | 105/148 |
| 6,283,038 | B1 | 9/2001 | Mattila | |
| D456,585 | S | 4/2002 | Sandstroem | |
| D464,783 | S | 10/2002 | Abbestam | |
| D511,580 | S | 11/2005 | Ryan et al. | |
| D515,266 | S | 2/2006 | Moe | |
| 7,845,285 | B2 | 12/2010 | Hast | |
| D650,143 | S | 12/2011 | Bhosale et al. | |
| 8,104,731 | B2 | 1/2012 | Faucher et al. | |
| D655,884 | S | 3/2012 | Spies et al. | |
| 8,251,329 | B2 | 8/2012 | Suciu et al. | |
| 8,464,478 | B2 | 6/2013 | Tweedie | |
| 8,590,456 | B2 | 11/2013 | Ipsen | |
| 2002/0079347 | A1 | 6/2002 | Ezumi et al. | |
| 2005/0098059 | A1 | 5/2005 | Wallner | |
| 2006/0137564 | A1 | 6/2006 | Wallner | |
| 2008/0041806 | A1 | 2/2008 | Birkigt et al. | |
| 2008/0230503 | A1 | 9/2008 | Birkigt et al. | |
| 2010/0096438 | A1 | 4/2010 | Sato et al. | |
| 2011/0191986 | A1 | 8/2011 | Smith | |
| 2013/0153730 | A1 | 6/2013 | Spies et al. | |
| 2013/0164078 | A1 | 6/2013 | Spies et al. | |
| 2013/0167750 | A1 | 7/2013 | Spies et al. | |

FOREIGN PATENT DOCUMENTS

| | | | |
|---|---|---|---|
| CN | 1312141 | A | 9/2001 |
| CN | 101595263 | A | 12/2009 |
| CN | 101595264 | A | 12/2009 |
| CN | 101641478 | A | 2/2010 |
| DE | 914895 | C | 9/1954 |
| DE | 1249301 | B | 9/1967 |
| DE | 7346004 | U | 4/1974 |
| DE | 3211923 | A1 | 10/1983 |
| DE | 3311362 | C1 | 7/1984 |
| DE | 3329328 | | 2/1985 |
| DE | 3326103 | | 3/1985 |
| DE | 4109051 | | 9/1992 |
| DE | 9310593 | | 9/1993 |
| DE | 29903470 | | 9/1999 |
| DE | 10115565 | A1 | 9/2002 |
| DE | 10337122 | | 3/2005 |
| DE | 10337121 | | 6/2005 |
| DE | 102006058422 | | 6/2008 |
| EP | 1031529 | | 2/2000 |
| EP | 1205420 | | 11/2000 |
| EP | 1928777 | | 8/2006 |
| FR | 2201561 | A1 | 4/1974 |
| GB | 687367 | | 2/1953 |
| GB | 1088878 | | 10/1967 |
| GB | 2117337 | A | 10/1983 |
| GB | 2137150 | A | 10/1984 |
| GB | 2458135 | | 9/2009 |
| JP | 2000042759 | | 2/2000 |
| SE | 9200711 | L | 9/1993 |

OTHER PUBLICATIONS

HB-System brochure by ABUS Kransysteme GmbH (Aug. 2009).
International Search Report and Written Opinion of corresponding PCT Application PCT/EP2011/065324 mailed Dec. 6, 2011.
International preliminary Examination Report from corresponding International Application PCT/EP2011/065324.

* cited by examiner

RAIL FOR SUSPENDED CONVEYORS AND SUSPENDED CRANES

CROSS REFERENCE TO RELATED APPLICATIONS

The present application claims the priority benefits of International Patent Application No. PCT/EP2011/065324, filed on Sep. 5, 2011, and also of German Patent Application No. DE 10 2010 037 522.5, filed on Sep. 14, 2010, which are hereby incorporated herein by reference in their entireties.

BACKGROUND OF THE INVENTION

The invention relates to a rail for suspension tracks and suspension cranes, having a profile head for suspending the rail and a profile body connected thereto, wherein as seen in cross-section the profile head is a substantially c-shaped profile head which is open at the top and whose opening forms a gap which runs along a longitudinal center plane and which is bounded on both sides by first web sections which extend outwards as seen from the longitudinal center plane, wherein two second web sections opposite each other and extending downwards and outwards are connected to the first web sections as seen in cross-section, wherein as seen in cross-section the rail is composed of two profiles which are disposed symmetrically with respect to the vertical longitudinal center plane.

Rails of this type typically comprise a rail head for the provision of a suspension for attachment to ceilings, walls etc. and a rail body for provision of the functional aspects, such as carriage tracks, support sections etc.

Corresponding self-supporting tubular running rails for suspension tracks, suspension cranes and the like are known e.g. from DE 1 249 301. In cross-section, the running rail described therein is composed e.g. of two thin-walled profiles which are disposed symmetrically with respect to the vertical longitudinal center plane and which surround roller pairs of a travelling mechanism having upper walls and sidewalls, which extend obliquely downwards towards the longitudinal center plane, and two tracks which are located on both sides of a lower slot and are inclined downwards towards this slot, and are provided at the top on the longitudinal center plane with a web which initially facing upwards and then outwards from the longitudinal center plane and which lies against the web of the second profile bar in the upwardly facing part and is connected thereto. The upper profile walls descend outwardly from the longitudinal center plane and the spacing between the oblique sidewalls is only of such a size that the running rail provides space for merely one travelling mechanism, of which the width is determined only by a plate-shaped support body and rollers disposed in a close-fitting manner thereon. The running rail is attached e.g. to the warehouse ceiling via the upwardly facing webs by means of a suspension, wherein the suspension embraces the upwardly facing webs in the outwardly facing part.

The HB-System brochure (status August 2009) by ABUS Kransysteme GmbH likewise discloses corresponding profile rails on page 11, which consist of two half shells which are welded together symmetrically with respect to the vertical longitudinal center plane, wherein the web thereof which initially points upwards and then points outwards finally projects back inwardly approximately horizontally in the direction of the vertical longitudinal center plane. A gap remains between the opposite ends of the webs, so that a substantially c-shaped profile head is produced which is open at the top. A universal joint suspension engages into this opening such that it lies with a lower plate internally against the webs and is screwed by means of screw bolts to a ball cup plate, on the outside of the webs, through the opening. Furthermore, the profiles of the running rail in the lower region at the lower slot for the travelling mechanism are each bent twice approximately at right angles below the slot firstly downwards and then outwards, so that a longitudinal groove is produced which extends on the outer side and in which rail section connectors (sleeves) can be disposed and which effect stiffening.

German patent application DE 101 15 565 A1 discloses a device for suspending rails for a suspension crane having a rail, which extends in a longitudinal direction, and a suspension. The rail consists of two mirror-symmetrical sheet metal profiles which are welded to each other below a profile head. The rail comprises a c-shaped profile head open at the top, having two webs and three web sections in each case. The webs extend in a first web section horizontally outwards and extend in an adjoining second web section almost vertically in an oblique manner outwards and downwards. Bent third web sections then follow which run towards each other in each case obliquely inwards and downwards and meet together.

German utility model document DE 73 46 004 U discloses a monorail suspension track having a rail, wherein carriages can travel along the longitudinal direction thereof. The rail consists of a profile head which as seen in cross-section is c-shaped and open at the top and to which there is connected a hook-shaped lower part which forms the running rail. In order to suspend the rail, a suspension element is inserted into the profile head in the longitudinal direction. For this purpose, the profile head has two webs each with four web sections which surround a receiving space, which is open at the top, for the suspension and form a gap which extends in the longitudinal direction of the rail. Starting from the gap, both webs extend in each case in a first web section obliquely outwards and upwards and merge in each case into a second web section which is bent and extends horizontally outwards. Connected to the second web section is in each case a third web section which is bent at an angle of 90 degrees and extends vertically downwards. A horizontal fourth web section connects the two webs at lower ends of the third web sections.

German patent specification DE 914 895 B describes a rail for a monorail trolley or a lightweight travelling crane which, as seen in cross-section, is in the form of an upside-down "T". This rail is also suspended on a suspension via a profile head formed on its upper end. The profile head has two webs each with three web sections. Starting from the gap, the two webs extend in each case in a first web section obliquely outwards and upwards and then descend in a bent second web section in a vertical manner downwards. The second web section is adjoined in each case by a third web section which descends obliquely inwards. Between lower ends of the third web sections a second gap is formed inside the receiving space.

U.S. Pat. No. 4,524,698 A and FR 2 201 561 A1 each disclose a rail having a c-shaped profile head which is open at the top, wherein a gap of the respective profile head is bounded by web sections which are round and semicircular in formation.

SUMMARY OF THE INVENTION

The present invention provides a rail for suspension tracks and suspension cranes which by means of its geometry in the region of the profile head at least supports an overload protection and permits simple attachment by means of suspensions. In addition, the rail should be rigid and permit good connection capabilities for rail sections.

In accordance with an embodiment of the invention, in the case of a rail for suspension tracks and suspension cranes, having a profile head for suspending the rail and a profile body connected thereto, wherein, as seen in cross-section, the profile head is a substantially c-shaped profile head which is open at the top and whose opening forms a gap which runs along a longitudinal center plane which is bounded on both sides by first web sections which extend outwards as seen from the longitudinal center plane, wherein two web sections opposite each other and extending downwards and outwards are connected to the first web sections as seen in cross-section, wherein as seen in cross-section the rail is composed of two profiles which are disposed symmetrically with respect to the vertical longitudinal center plane, an overload protection by means of the geometry in the region of the profile head is at least partially supported and a simple attachment by means of suspensions is allowed by virtue of the fact that the first web sections extend starting from the longitudinal center plane approximately in a V-shaped manner obliquely outwards and upwards and that between the first web sections and a horizontal aligned at a right angle to the longitudinal center plane an angle is formed which is 15 to 35 degrees, preferably 20 to 30 degrees. Since the first web sections do not project back approximately horizontally in the direction of the vertical longitudinal center plane as in the prior art (HB-System by ABUS, see above), but rather extend obliquely outwards and upwards, i.e., are disposed substantially approximately in a V-shaped manner, they prevent the rail profile itself from bending up in the event of an extreme overload. Therefore, in the event of an overload the clamping effect upon a suspension disposed in the gap is even reinforced, as in the event of an overload the first web sections are "pulled" towards each other.

This is of importance, since even in the case of an overload the connection between the rail or the profile head thereof and the suspension or the connection element must not be allowed to fail. By reason of the particular geometry of the profile head of the rail in accordance with the invention it is ensured that the rail is not the weakest link in the chain.

If third web sections which project back horizontally inwards in the direction of the vertical longitudinal center plane are finally connected to the second web sections, i.e., the profile head is broader at the base and narrows in the direction away from the profile body, a suspension can be used for the rail which can be "pivoted in" through the gap into the hollow profile head, as the diagonal extension (as seen in cross-section) is thus large enough to receive a pivot-in part of a suspension which is subsequently pivoted approximately horizontally and engages in a positive-locking manner into the beads of the profile head which are formed by the first web sections. Therefore, when the profile head and the suspension or the pivot-in part thereof are dimensioned in a corresponding and mutually tailored manner, the profile head is held in a simple manner in the transverse direction by means of a positive-locking arrangement.

As already stated in the introduction, the profile head of the rail is used for attachment to ceilings, walls etc. via a suspension and the profile body of the rail is used for provision of the functional aspects, such as carriage tracks, support sections etc.

To this end it is advantageous if the profile body forms, together with upper, substantially horizontally extending profile walls and profile sidewalls extending in a slightly oblique manner downwards towards the longitudinal center plane and two lower profile walls located on both sides of a lower slot and inclined downwards towards this slot, a cavity for travelling mechanisms, wherein the lower profile wall may further continue at the slot substantially downwards and then obliquely outwards and finally obliquely downwards. This allows further stiffening of the rail in the region of the profile body and additionally allows one end of the weld seam of the welded tubes or sleeves which are typically used for the butt joint of rail sections to be guided out.

These sleeves are generally welded in longitudinal grooves, which extend externally on the rail, along their two sides. However, in the case of the rails from the prior art the weld seam is located in the region of maximum tension, namely on the edge of the profile. The option of guiding out the weld seam ensures that it can terminate outside this region. Therefore, the run-out notch of the weld seam is positioned by drawing the weld seam further outside the critical region of the welding gap, whereby an increase in tension is achieved by a sudden change in geometry and local separation of the run-out notch, so that ultimately the holding means (sleeves) can be loaded to a greater extent. This also allows overall greater loading of the connection of the rail sections.

In a particular embodiment, the angle of the lower profile wall which is continued obliquely downwards is 90 to 130 degrees relative to the longitudinal center plane, but may be 100 to 120 degrees and in particular 110 degrees. In this angle range, the optimum weld seam progression is linked to the greater stiffening in a particularly effective manner.

In order to connect the profile head to the profile body, it is provided in a particular embodiment that fourth web sections which extend approximately along the longitudinal center plane and are connected to the third web sections connect the profile head to the profile body via its upper profile walls. The web sections are dimensioned such that connection sleeves can be received approximately halfway in the longitudinal groove formed correspondingly on the outer side of the rail.

It is also possible to connect the halves of the rail together in this region, for which reason the fourth web sections of the profile head lie against one another in the upwardly facing region and are connected together at this location.

The rails in accordance with the invention can be used in a variety of ways. However, they are particularly adapted for use as a running rail and/or support rail for single-girder or dual-girder suspension cranes.

Further details, features and advantages of the invention are apparent from the subsequent description of an exemplified embodiment with reference to the drawing.

DESCRIPTION OF THE PREFERRED EMBODIMENTS

Figure 1:
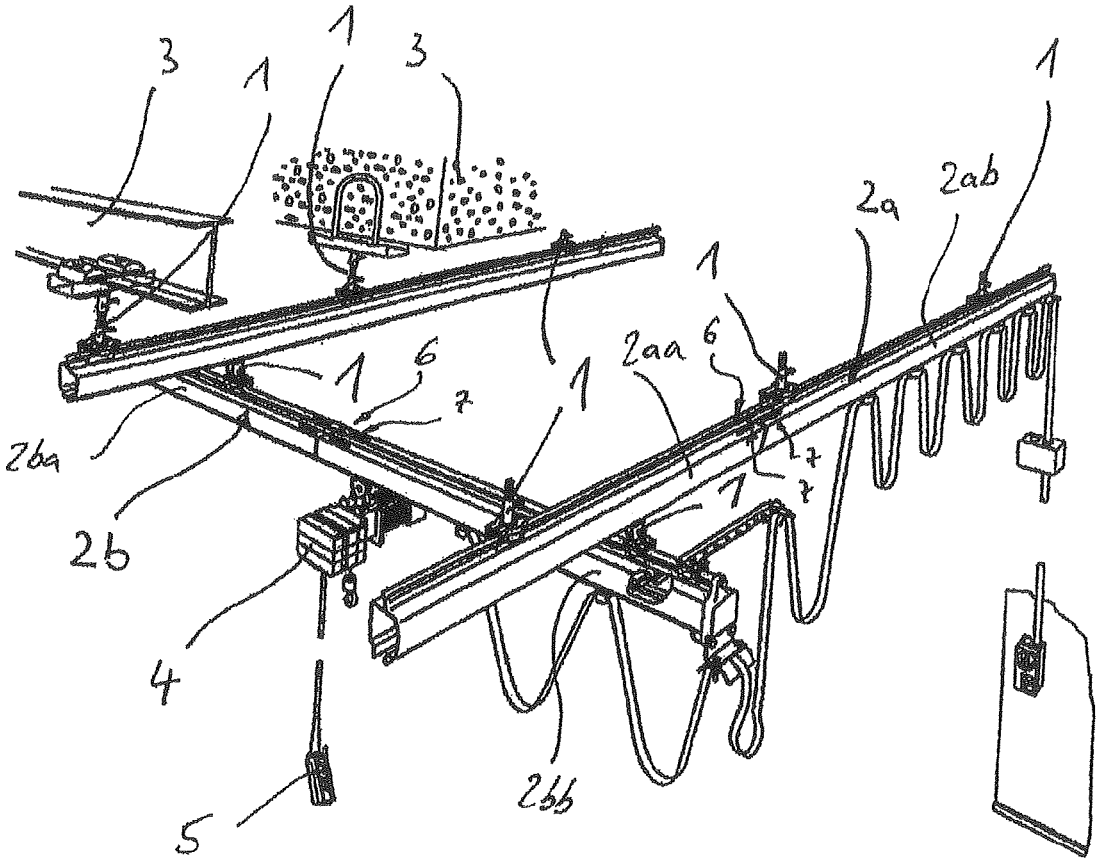
FIG. 1 shows a perspective and schematic view of a single-girder suspension crane in accordance with the prior art to illustrate the possible uses of corresponding rails.

In order to illustrate the most varied possible uses of connected rail sections for the purpose of forming rails, FIG. 1 shows a single-girder suspension crane.

Substantially horizontally extending rails 2 which are open at the bottom and profiled in a c-shape are suspended on support elements 3 or further rails 2 by means of suspension devices 1. The support elements 3 are formed as I-beams. Since the present exemplified embodiment relates to a single-girder suspension crane, there are provided two first rails 2*a* which extend substantially horizontally, in parallel and at a mutual spaced interval and which are used as running rails of the single-girder suspension crane, along with a second rail 2*b* which forms a crane rail which is aligned substantially transversely with respect to the first rails 2*a* and can travel along the first rails 2*a*. For this purpose, the second rail 2*b* is suspended via two suspension devices 1 in each case on a travelling mechanism which is not illustrated and can travel along the first rails 2*a*. In a typical manner, a lifting gear 4 such as a chain hoist or cable pull is suspended on the second rail 2*b* and can travel with a further travelling mechanism, not illustrated, along the second rail 2*b*. The lifting gear 4 can be controlled via a pendant switch 5 suspended on the lifting gear 4.

The rails 2*a*, 2*b* can thus optionally be used as crane track rails or carrier rails.

A rail 2 in accordance with the invention will now be described with reference to FIGS. 2 to 5.

The rails 2*a* and 2*b* consist, in each case depending upon length requirement, of two or more rail sections 2*aa* and 2*ab* or 2*ba* and 2*bb*.

The rails sections 2*aa* and 2*ab* or 2*ba* and 2*bb* are connected together via end-face butt joints 6.

Figure 2:
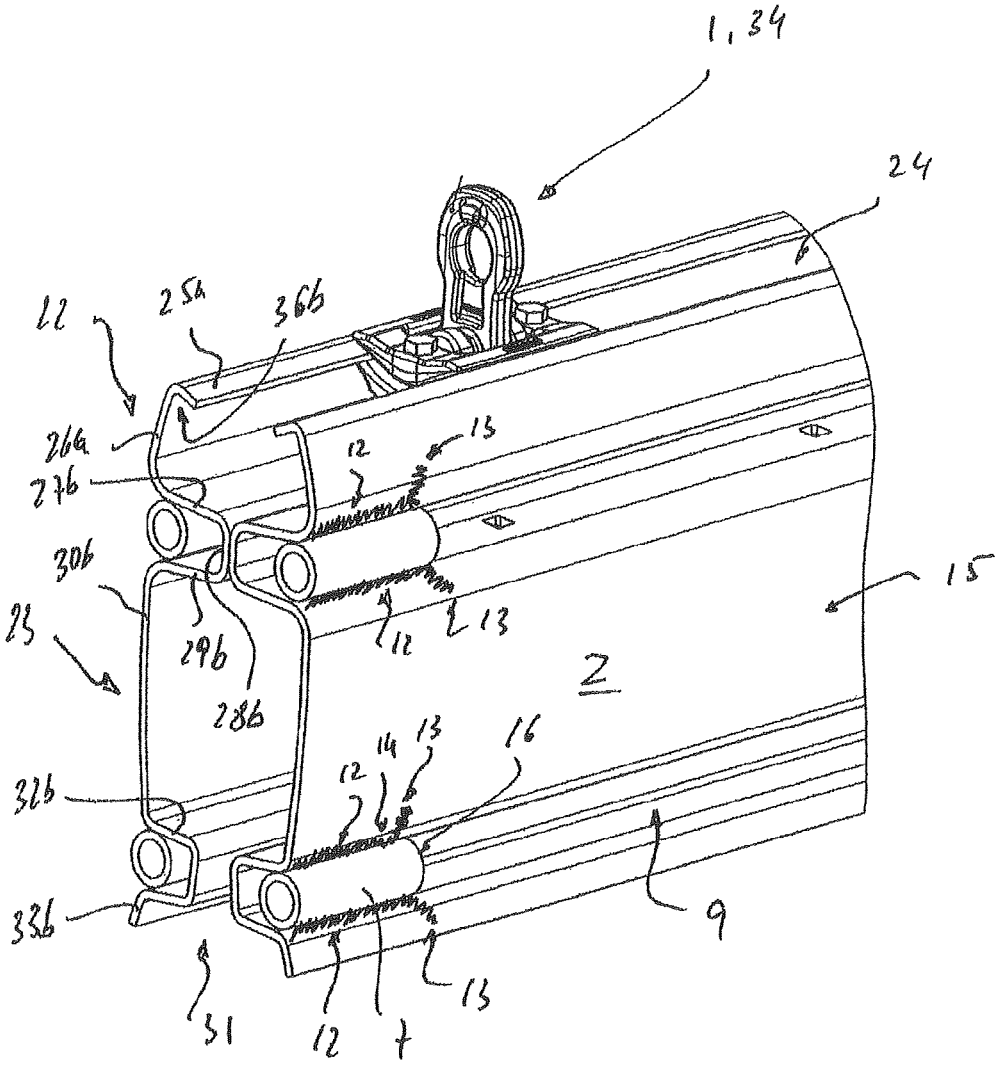
FIG. 2 shows a perspective view of a rail in accordance with the invention.
Figure 3:
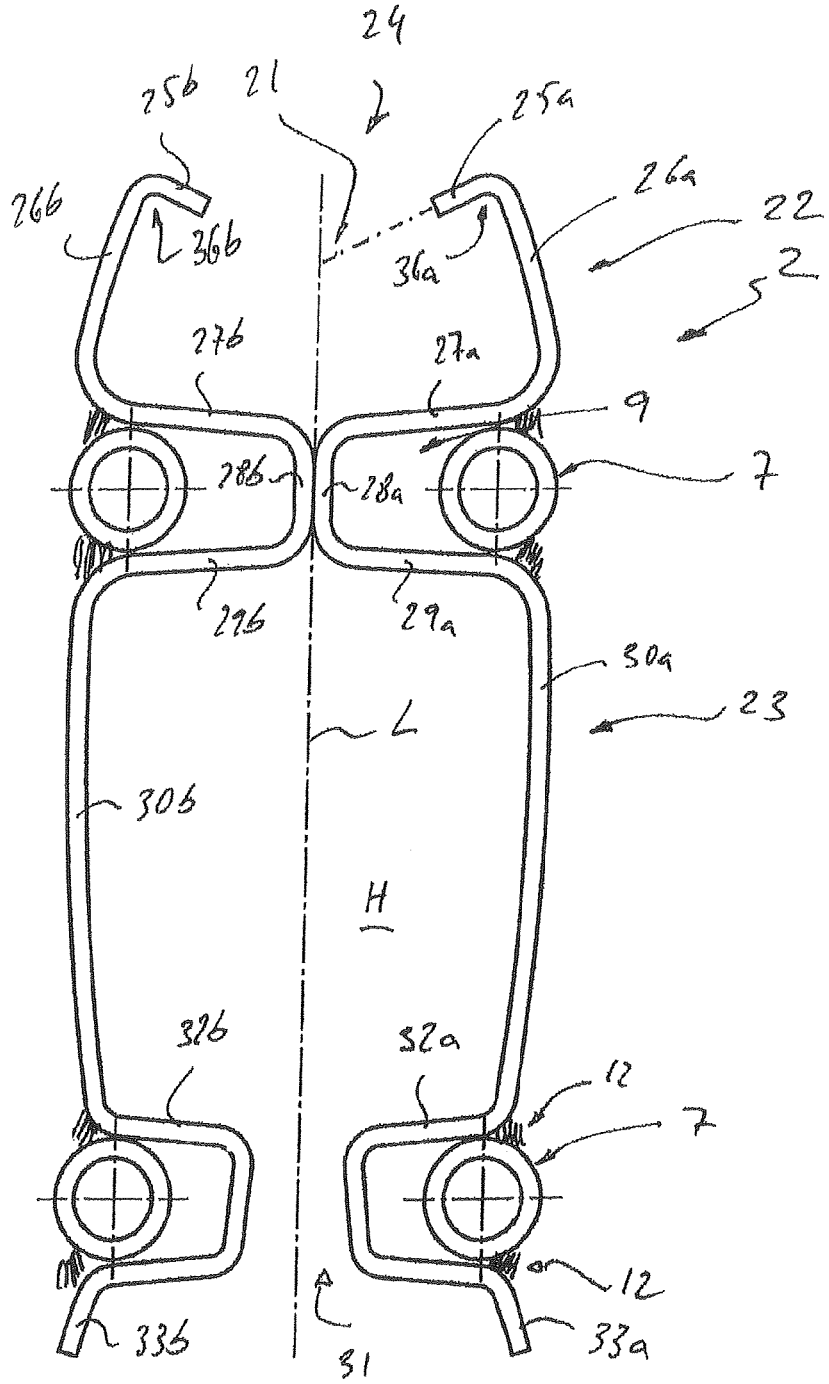
FIG. 3 shows a cross-section of the rail of FIG. 2.
Figure 4:
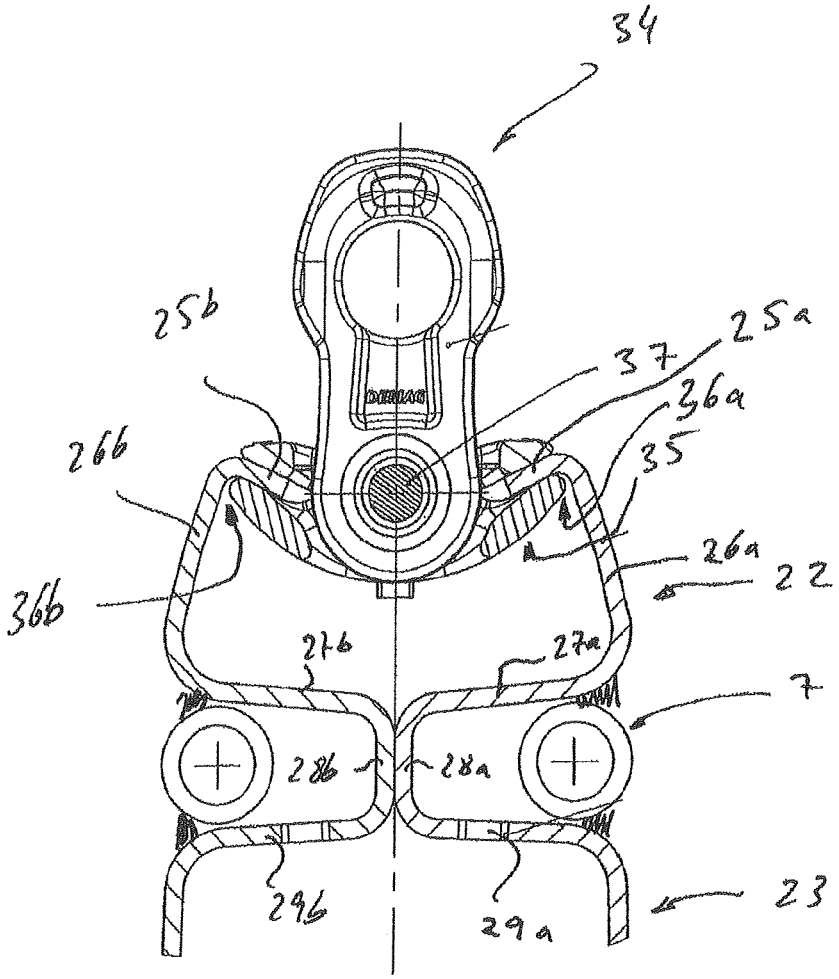
FIG. 4 shows a cross-section of the rail of FIG. 2 in the region of the suspension of the profile head.
Figure 5:
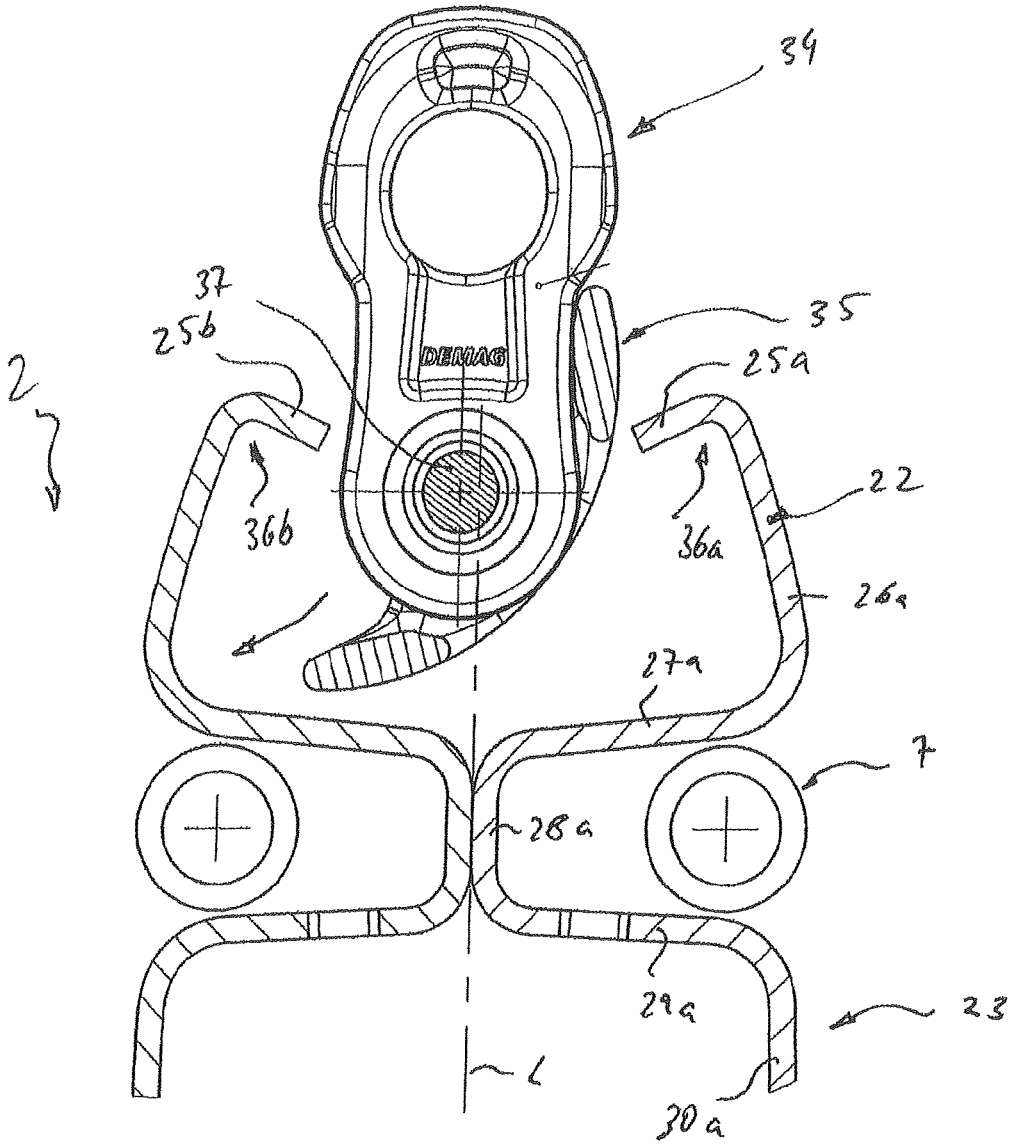
FIG. 5 shows the cross-section of FIG. 4 as the suspension is introduced.

The butt joint 6 of the rail sections 2*aa* and 2*ab* will be explained hereinafter by way of example only, with reference to FIGS. 2 and 3, since the butt joint of the rail sections 2*ba* and 2*bb* is formed accordingly. The profile of the rail sections of FIGS. 2 and 3 is only similar, but not identical, to that of FIG. 1.

In order to form the butt joints 6 of the rail sections 2*aa* and 2*ab*, the rail sections 2*aa* and 2*ab* have in each case holding elements which are formed on their outer sides as sleeves 7 and which are disposed on the rail section ends 8 in longitudinally extending angular spaces or grooves 9 in the rail sections 2*aa* and 2*ab*.

In the illustrated example, four sleeves 7 are used for each rail section and are disposed in each case in corresponding longitudinal grooves 9. Two sleeves 7 are provided for each rail section longitudinal side.

The sleeves 7 have screw bolts inserted through them as connection elements and form for their heads or their nuts a bearing surface 16, which extends transversely with respect to the longitudinal direction of the rail sections, as a counter bearing surface.

The sleeves 7 are attached to the rail sections 2*aa* and 2*ab* in each case by means of a weld seam 12, which extends in the longitudinal direction of the rail section 2*aa* and 2*ab*, on each of the two longitudinal sides of the sleeves 7. The weld seams 12 do not have to extend over the entire length of the sleeves 7 and can be formed differently from one another.

The end 13 of the weld seam 12 facing away from the end face deviates from the longitudinal direction. In doing so, the end 13 forms with respect to the rest of the weld seam 12 an angle 14 and extends out of the groove 9 as far as onto the lateral surface 15 of the rail profile or the continued profile wall.

The rail 2 consists in cross-section of two identical profiles 20*a*, 20*b* which are disposed symmetrically with respect to the vertical longitudinal center plane L.

The rail has a profile head 22 which is disposed at the top relatively along the longitudinal center plane L and a profile body 23 which is connected thereto and located underneath.

As seen in cross-section, the profile head 22 is a substantially C-shaped profile head which is open at the top and whose opening forms a gap 24 which extends along the longitudinal center plane L and is bounded on both sides by first web sections 25*a*, 25*b* which as seen from the longitudinal center plane L extend obliquely outwards and upwards at the same time.

The angle 21 of the web sections 25*a*, 25*b* is approximately 25 degrees relative to the longitudinal center plane L.

Furthermore, the profile head 22 has in cross-section two opposite, downwardly and outwardly extending second web sections 26*a*, 26*b* which are connected to the first web sections 25*a*, 25*b*, and finally has third web sections 27*a*, 27*b* which project back inwardly in the direction of the vertical longitudinal center plane L and are connected to the second web sections 26*a*, 26*b*.

In other words, the profile head 22 is broader at its base and narrows in the direction away from the profile body 23. Therefore, a suspension 34 can be used for the rail 2 which can be "pivoted" into the hollow profile head 22 through the gap 24, since the diagonal extension (as seen in cross-section) is thus large enough to receive a pivotable pivot-in part 35 of the suspension 34 which is then pivoted approximately horizontally and engages in a positive-locking manner into the beads 36*a*, 36*b* of the profile head 22 which are formed by the first web sections 25*a*, 25*b*. Therefore, when the profile head 22 and the suspension 34 or the pivot-in part 25 thereof are dimensioned in a corresponding and mutually tailored manner, the profile head 22 is held in a simple manner in the transverse direction by means of a positive-locking arrangement.

Alternatively, the height of the profile head 22 would have to be substantially greater and the rail 2 could be formed overall in a less compact and stiff manner.

In order to attach and fix the suspension 34 to the profile head 22, the said pivot-in part 35 is initially pivoted lying on one side approximately perpendicularly on the suspension, so that it can be introduced with the other side into the gap 24.

The suspension 34 is then pushed with the pivot-in part 35 obliquely into one of the lower corners of the profile head 22 which are formed by the web sections 26*a*, 27*a* or 26*b*, 27*b*.

It is then possible to introduce the other end of the pivot-in part 35 past the web section 25*a* or 25*b* into the gap 24 and finally pivot the pivot-in part horizontally and introduce it into the beads 36*a*, 36*b*.

Therefore, the suspension 34 already supports the rail 2 via the pivot-in part 35 without a screw-connection etc. The entire loading is thus absorbed by the pivot bolt 37 of the suspension which can be dimensioned to be substantially more load-bearing than a normal screw bolt of a clamping connection from the prior art.

In addition, fourth web sections 28*a*, 28*b* extending approximately along the longitudinal center plane L are provided on the profile head 22 and are connected to the third web sections 27*a*, 27*b* and connect the profile head 22 to the profile body 23 via upper profile walls 29*a*, 29*b* thereof.

The fourth web sections 28*a*, 28*b* of the profile head 22 lie one against the other and are welded together at this location. The profiles 20*a*, 20*b* are thus connected to form the rail 2.

The profile body 23 forms, together with upper, substantially horizontally extending profile walls 29*a*, 29*b* and profile sidewalls 30*a*, 30*b* extending in a slightly oblique manner downwards towards the longitudinal center plane L, and two lower profile walls 32*a*, 32*b* located on both sides of a lower slot 31 and inclined slightly downwards towards this slot, a cavity H for travelling mechanisms, wherein lower profile walls 32*a*, 32*b* form a running surface for the corresponding wheels. In addition, a contact line can be disposed in the region of the upper profile walls 29*a*, 29*b*.

The lower profile wall 32*a*, 32*b* at the slot 31 is continued substantially downwards and then obliquely outwards and finally obliquely downwards. The end sections 33*a*, 33*b* of the lower profile wall 32*a*, 32*b* which are thus produced allow the weld seam 12 to be guided out as explained above.

The angle of the end sections 33*a*, 33*b* of the lower profile wall 32*a*, 32*b* is approximately 110 degrees relative to the horizontal.

The invention claimed is:

1. Rail for suspension tracks and suspension cranes, having a profile head by which the rail is suspended and a profile body connected to the profile head and configured to receive traveling mechanisms of suspension cranes, wherein as seen in cross-section the profile head is a substantially c-shaped profile head which is open at the top and whose opening forms a gap which runs along a longitudinal center plane which is bounded on both sides by substantially planar first web sections which extend outwards as seen from the longitudinal center plane, wherein two substantially planar second web sections opposite each other and extending downwards and outwards are connected to the substantially planar first web sections as seen in cross-section, wherein as seen in cross-section the rail is composed of two profiles which are disposed symmetrically with respect to the vertical longitudinal center plane, wherein the substantially planar first web sections extend starting from the longitudinal center plane approximately in a V-shaped manner obliquely outwards and upwards and that between the substantially planar first web sections and a horizontal aligned at a right angle to the longitudinal center plane an angle is formed which is 15 to 35 degrees, wherein the first web sections are substantially perpendicular to the respective second web sections.

2. Rail as claimed in claim 1, wherein third web sections which project back horizontally inwards in the direction of the vertical longitudinal center plane are connected to the second web sections.

3. Rail as claimed in claim 2, wherein the profile body forms, together with upper, substantially horizontally extending profile walls and profile sidewalls extending in a slightly oblique manner downwards towards the longitudinal center plane, and two lower profile walls located on both sides of a lower slot and inclined downwards towards this slot, a cavity for travelling mechanisms.

4. Rail as claimed in claim 3, wherein the lower profile wall is continued at the slot substantially downwards and then obliquely outwards and finally obliquely downwards.

5. Rail as claimed in claim 4, wherein the angle of the profile wall which is continued obliquely downwards is 90 to 130 degrees relative to the longitudinal center plane.

6. Rail as claimed in claim 5, wherein fourth web sections which extend approximately along the longitudinal center plane and are connected to the third web sections connect the profile head to the profile body via upper profile walls thereof.

7. Rail as claimed in claim 6, wherein the fourth web sections of the profile head lie one against the other in the upwardly facing region and are connected together at this location.

8. Rail as claimed in claim 1, wherein said rail comprises a running rail and/or support rail for single-girder or dual-girder suspension cranes.

9. Rail as claimed in claim 1, wherein the profile body forms, together with upper, substantially horizontally extending profile walls and profile sidewalls extending in a slightly oblique manner downwards towards the longitudinal center plane, and two lower profile walls located on both sides of a lower slot and inclined downwards towards this slot, a cavity for travelling mechanisms.

10. Rail as claimed in claim 9, wherein the lower profile wall is continued at the slot substantially downwards and then obliquely outwards and finally obliquely downwards.

11. Rail as claimed in claim 10, wherein the angle of the profile wall which is continued obliquely downwards is 90 to 130 degrees relative to the longitudinal center plane.

12. Rail as claimed in claim 11, wherein fourth web sections which extend approximately along the longitudinal center plane and are connected to the third web sections connect the profile head to the profile body via upper profile walls thereof.

13. Rail as claimed in claim 12, wherein the fourth web sections of the profile head lie one against the other in the upwardly facing region and are connected together at this location.

14. Rail as claimed in claim 9, wherein fourth web sections which extend approximately along the longitudinal center plane and are connected to the third web sections connect the profile head to the profile body via upper profile walls thereof.

15. Rail as claimed in claim 14, wherein the fourth web sections of the profile head lie one against the other in the upwardly facing region and are connected together at this location.

16. Rail as claimed in claim 2, wherein fourth web sections which extend approximately along the longitudinal center plane and are connected to the third web sections connect the profile head to the profile body via upper profile walls thereof.

17. Rail as claimed in claim 16, wherein the fourth web sections of the profile head lie one against the other in an upwardly facing region and are connected together at this location.

18. Rail as claimed in claim 4, wherein fourth web sections which extend approximately along the longitudinal center plane and are connected to the third web sections connect the profile head to the profile body via upper profile walls thereof.

19. Rail as claimed in claim 18, wherein the fourth web sections of the profile head lie one against the other in an upwardly facing region and are connected together at this location.

20. Rail as claimed in claim 1, wherein said angle formed between the first web sections and a horizontal aligned at a right angle to the longitudinal center plane is 20 to 30 degrees.

* * * * *